US011335183B2

(12) United States Patent
Miagkov et al.

(10) Patent No.: US 11,335,183 B2
(45) Date of Patent: May 17, 2022

(54) SYSTEM AND METHOD FOR TESTING NETWORKED ALARM UNITS

(71) Applicant: CARRIER CORPORATION, Palm Beach Gardens, FL (US)

(72) Inventors: Valeriy V. Miagkov, Colorado Springs, CO (US); Narval Danvers, Denver, CO (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/053,201

(22) PCT Filed: Apr. 30, 2019

(86) PCT No.: PCT/US2019/029816
§ 371 (c)(1),
(2) Date: Nov. 5, 2020

(87) PCT Pub. No.: WO2019/217139
PCT Pub. Date: Nov. 14, 2019

(65) Prior Publication Data

US 2021/0142653 A1 May 13, 2021

Related U.S. Application Data

(60) Provisional application No. 62/670,365, filed on May 11, 2018.

(51) Int. Cl.

| | |
|---|---|
| ***G08B 29/12*** | (2006.01) |
| ***G08B 29/14*** | (2006.01) |
| ***G08B 29/22*** | (2006.01) |

(52) U.S. Cl.
CPC ..... *G08B 29/126* (2013.01); *G08B 29/14* (2013.01); *G08B 29/22* (2013.01)

(58) Field of Classification Search
CPC .. G08B 29/126; G08B 29/145; G08B 25/008; G08B 25/14; G08B 29/00; F24F 11/30
See application file for complete search history.

(56) References Cited

U.S. PATENT DOCUMENTS 3,717,862 A 2/1973 Sasaki
4,176,346 A 11/1979 Johnson et al.
(Continued)

FOREIGN PATENT DOCUMENTS

WO 2017216539 A1 12/2017

OTHER PUBLICATIONS

International Search Report and Written Opinion; Application No. PCT/US2019/029816; dated Jun. 26, 2019; 14 pages.
IPRP; PCT/US2019/029816; dated Nov. 26, 2020; 8 pages.

*Primary Examiner* — Mirza F Alam
(74) *Attorney, Agent, or Firm* — Cantor Colburn LLP

(57) ABSTRACT

Disclosed is an alarm unit having an alarm controller, the alarm controller being operatively connected to a plurality of implements within the alarm unit having a mechanical actuator and a magnetic sensor and at least one of a visual source and an audible source, wherein the alarm unit: monitors for input to initiate one of a plurality of self-tests including: a first test, initiated by actuation of the mechanical actuator without actuation of the magnetic sensor, and a second test, initiated by actuation of the mechanical actuator with actuation of the magnetic sensor, and wherein the first test differs from the second test.

14 Claims, 5 Drawing Sheets

(56) References Cited

U.S. PATENT DOCUMENTS

| | | | |
|---|---|---|---|
| 4,517,554 | A | 5/1985 | Moser et al. |
| 5,497,009 | A | 3/1996 | Torikoshi et al. |
| 5,523,744 | A | 6/1996 | Wieser |
| 5,621,394 | A | 4/1997 | Garrick et al. |
| 5,691,699 | A | 11/1997 | Vane et al. |
| 5,821,866 | A | 10/1998 | Bernal et al. |
| 6,313,744 | B1 | 11/2001 | Capowski et al. |
| 6,624,750 | B1 | 9/2003 | Marman et al. |
| 6,769,285 | B2 | 8/2004 | Schneider et al. |
| 6,950,016 | B2 | 9/2005 | Farley |
| 7,057,518 | B2 | 6/2006 | Schmidt |
| 7,158,023 | B2 | 1/2007 | Kaiser |
| 7,242,288 | B2 | 7/2007 | Kaiser et al. |
| 7,649,450 | B2 | 1/2010 | Campion et al. |
| 7,786,854 | B2 | 3/2010 | Hosey |
| 8,232,884 | B2 | 7/2012 | Pattok et al. |
| 8,698,613 | B2 | 4/2014 | McEvoy |
| 8,994,525 | B2 | 3/2015 | Piccolo et al. |
| 9,007,201 | B2 | 4/2015 | Piccolo et al. |
| 9,030,314 | B2 | 5/2015 | Piccolo, III et al. |
| 9,076,313 | B2 | 7/2015 | Piccolo et al. |
| 9,552,720 | B2 | 1/2017 | Moffa |
| 9,767,679 | B2 | 9/2017 | Piccolo et al. |
| 9,830,806 | B2 | 11/2017 | Cree et al. |
| 9,858,802 | B2 | 1/2018 | Stafford |
| 9,875,644 | B2 | 1/2018 | Chiarizio et al. |
| 2004/0257235 | A1* | 12/2004 | Right ..... F24F 11/30 340/628 |
| 2009/0128353 | A1* | 5/2009 | Gonzales ..... G08B 25/04 340/691.5 |
| 2011/0074590 | A1 | 3/2011 | Sacknoff et al. |
| 2012/0286951 | A1* | 11/2012 | Hess ..... G08B 25/14 340/539.1 |
| 2014/0266677 | A1* | 9/2014 | Piccolo, III ..... G08B 29/126 340/514 |
| 2016/0247385 | A1* | 8/2016 | Stafford ..... G08B 25/08 |
| 2017/0104823 | A1 | 4/2017 | Capps |
| 2017/0287318 | A1 | 10/2017 | Moffa |
| 2017/0287319 | A1 | 10/2017 | Moffa |
| 2018/0012482 | A1 | 1/2018 | Brown et al. |
| 2018/0061217 | A1 | 3/2018 | Eichler |

* cited by examiner

SYSTEM AND METHOD FOR TESTING NETWORKED ALARM UNITS

CROSS REFERENCE TO RELATED APPLICATIONS

This is a US National Stage of Application No. PCT/US19/029816, filed on Apr. 4, 2019, which claims the benefit of Provisional Application No. 62/670,365 filed May 11, 2018, the disclosures of which are incorporated herein by reference.

BACKGROUND

Exemplary embodiments pertain to the art of testing alarm units and more specifically to performing a system test on networked alarm units.

In hotels, offices, dormitories, and the like, unauthorized initiating of a system test on networked alarm units may cause a significant nuisance that affects staff, guests, employees, residence, to name a few. In addition, unauthorized cancelling of a system test on a remote alarm unit in a network of alarm units, for example by premature actuating of the test/hush button, may skew test results for the remote alarm unit. Thus, a remote alarm unit may be deemed operational or defective when the opposite may be correct. A system is therefore needed where an ability to execute a system test and to cancel a test on a remote alarm unit is not readily accessible to unauthorized persons.

BRIEF DESCRIPTION

Disclosed is an alarm unit having an alarm controller, the alarm controller being operatively connected to a plurality of implements within the alarm unit having a mechanical actuator and a magnetic sensor and at least one of a visual source and an audible source, wherein the alarm unit: monitors for input to initiate one of a plurality of self-tests including: a first test, initiated by actuation of the mechanical actuator without actuation of the magnetic sensor, and a second test, initiated by actuation of the mechanical actuator with actuation of the magnetic sensor, and wherein the first test differs from the second test.

In addition to one or more of the above disclosed features or as an alternate the alarm unit is a first alarm unit of a plurality of alarm units, the plurality of alarm units forming an alarm system, and wherein the first test is a self-test initiated by the first alarm unit as a standalone test and the second test is a self-test initiated by the first alarm unit as part of an alarm system test.

In addition to one or more of the above disclosed features or as an alternate the first test comprises the first alarm unit performing the self-test when the mechanical actuator is first actuated and thereafter a first period of time lapses without a second actuation of the mechanical actuator.

In addition to one or more of the above disclosed features or as an alternate the first test comprises the first alarm unit cancelling the self-test upon the second actuation of the mechanical actuator within the first period of time.

In addition to one or more of the above disclosed features or as an alternate the second test comprises the first alarm unit providing the plurality of alarm units with a first instruction to perform the self-test after the mechanical actuator is first actuated and thereafter the magnetic sensor is engaged within a second period of time.

In addition to one or more of the above disclosed features or as an alternate the second test comprises the first alarm unit providing the plurality of alarm units with a second instruction to perform the self-test after a third period of time lapses without a second actuation of the mechanical actuator.

In addition to one or more of the above disclosed features or as an alternate the second test comprises the first alarm unit performing the self-test after the third period of time lapses without the second actuation of the mechanical actuator.

In addition to one or more of the above disclosed features or as an alternate the plurality of self-tests includes a third test, which is a self-test as a part of a system test, initiated by the first alarm unit following receiving a first instruction from a second alarm unit of the plurality of alarm units.

In addition to one or more of the above disclosed features or as an alternate the third test comprises the first alarm unit performing the self-test after receiving a second instruction from the second alarm unit during a fourth period of time that runs after receiving the first instruction.

In addition to one or more of the above disclosed features or as an alternate the third test comprises the first alarm unit cancelling the self-test after the fourth period of time has lapsed without receiving the second instruction from the second alarm unit.

BRIEF DESCRIPTION OF THE DRAWINGS

The following descriptions should not be considered limiting in any way. With reference to the accompanying drawings, like elements are numbered alike.

DESCRIPTION

A detailed description of one or more embodiments of the disclosed apparatus and method are presented herein by way of exemplification and not limitation with reference to the Figures.

Figure 1:
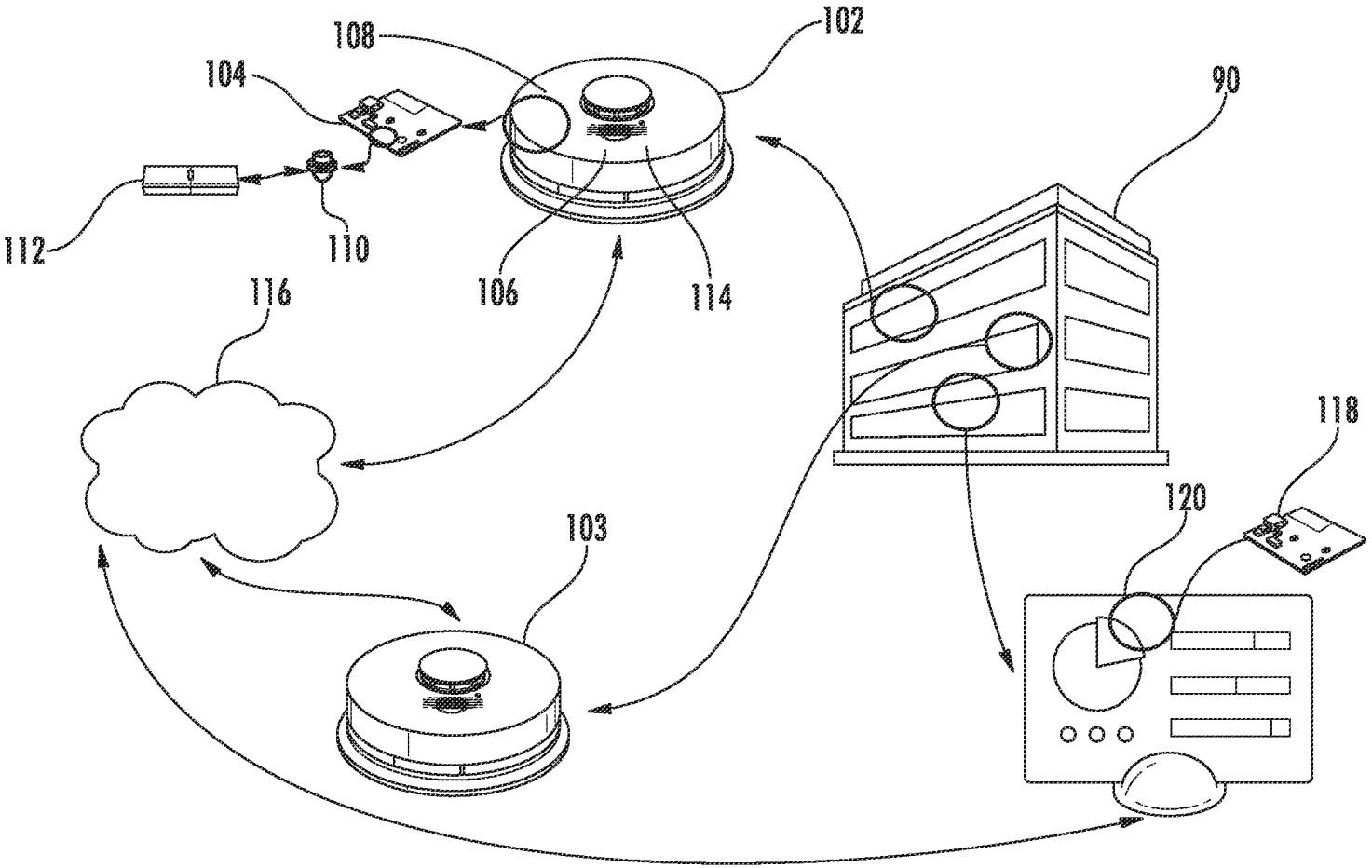
FIG. 1 illustrates an environment for utilizing the disclosed embodiments.

An environment for the disclosed innovation is illustrated in FIG. 1. A building or complex 90, such as a commercial or residential building or set of buildings, may have a plurality of alarm units. The alarm units may include a first alarm unit 102 and a second alarm unit 103. The alarm units may be communicatively connected detectors configured to detect hazardous conditions such as smoke, fire (heat), carbon monoxide, or the like. The alarm units 102, 103 may be substantially identical in that they are configured to detect the same conditions, or each may detect different hazardous conditions. However, both alarm units 102, 103 may be configured as described below. Accordingly, the following disclosure will focus on the first alarm unit 102 which will alternatively be referred to as alarm unit 102. In addition, reference hereinafter to the second alarm unit 103 may be interpreted as reference to any of the plurality of alarm units other than the first alarm unit 102.

The alarm unit 102 may include an alarm controller 104 which may be an electronic controller that is operably connected to a plurality of implements within the alarm unit 102. The plurality of implements may include an audible source such as an alarm speaker or sounder 106 as well as a first actuator 108 which may be a mechanical actuator and more specifically a test/hush button. The plurality of implements may also include a second actuator 110 which may be a magnetic sensor which may be engaged when a magnet 112 is positioned proximate the alarm unit 102. The plurality of implements may further include a visual implement 114, which is a visual source such as a light emitting diode (LED). Operation of the plurality of implements 106, 108, 110, and 114 is discussed below. Other implements (not shown) may be operably connected to alarm controller 104 such as a detection unit for detection of hazards such as smoke, fire (heat), carbon monoxide, gas, or the like.

The plurality of alarm units may communicate over a network 116 with a system monitor 118 which may be an electronic monitor within a network control hub 120. In some embodiments network control hub 120 may be one of the plurality of alarm units, i.e. system monitor 118 may be housed within one of the plurality of alarm units. The system monitor 118 may be able to provide an alert when, for example, the second alarm unit 103 develops an operational fault and should be replaced. When the system monitor 118 is part of the control hub 120 and includes a screen or panel 121, the alert may be in the form of a visual alert. When the system monitor 118 is part of an alarm unit, the alert may be in the form of an audio alert from the speaker 106 or a visual alert in the form of an emitted light pattern from the light source 114.

The network 116 may include hard-wired communications paths. The network 116 may apply wireless telecommunication protocols such as electronic short range communications (SRC) protocols, such as private area network (PAN) protocols. PAN technologies include, for example, Bluetooth Low Energy (BTLE), which is a wireless technology standard designed and marketed by the Bluetooth Special Interest Group (SIG) for exchanging network access codes (credentials) over short distances using short-wavelength radio waves. PAN technologies also include Zigbee, a technology based on Section 802.15.4 from the Institute of Electrical and Electronics Engineers (IEEE). More specifically, Zigbee represents a suite of high-level communication protocols used to create personal area networks with small, low-power digital radios for low-power low-bandwidth needs, and is suited for small scale projects using wireless connections. Alternatively, the network 116 may utilize local area network (LAN) protocols such as WiFi, which is a technology based on the Section 802.11 from the IEEE. Alternatively, a proprietary communications protocol may be utilized. Of course, these are non-limiting examples of wireless telecommunication protocols.

Figure 2:
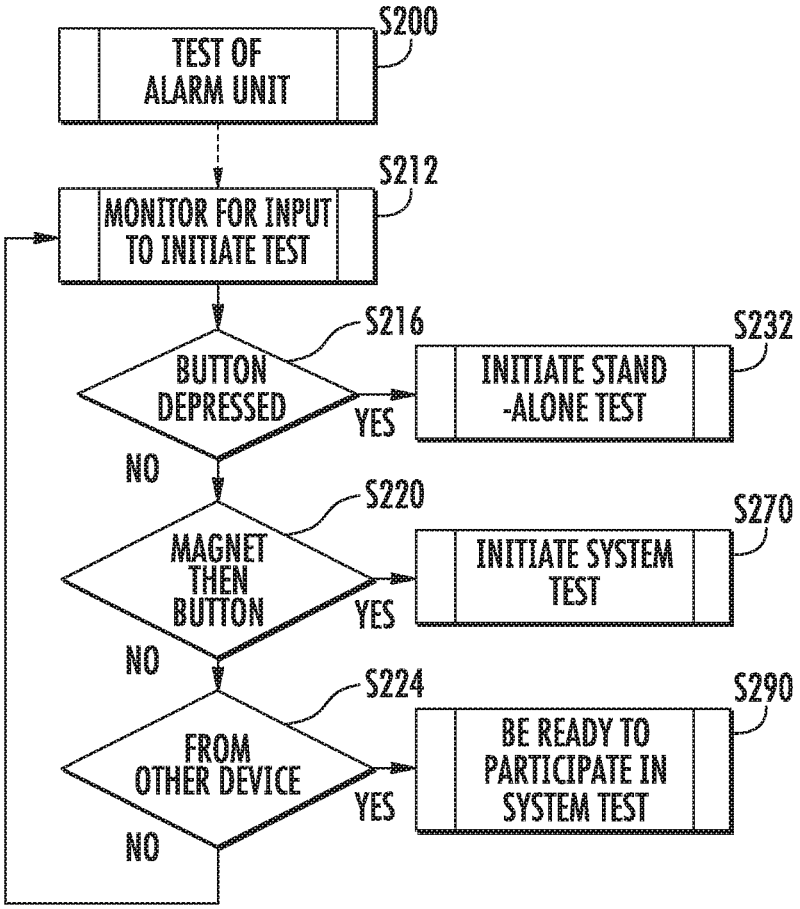
FIG. 2 is a process map illustrating a disclosed embodiment.

Turning to FIG. 2, at step S200 the alarm unit 102 executes a process for initiating one of a plurality of exemplary types of self-tests, disclosed in detail below. Note that although the process for initiating the tests is described below, the substance of the tests may involve additional steps such as testing the functionality additional implements of the units 102 and/or 103 such as detector modules configured to detect hazardous conditions, communications modules for hard-wired or wireless communications as described above, and other functions of a communicatively connected alarm unit 102.

At step S212, the alarm unit 102 may monitor for input to perform one of the three exemplarity self-tests. Step S212 may include step S216 of the alarm unit 102 monitoring for depression of the button 108, which would execute a first type of self-test, which is a self-test as part of a standalone test and which is further illustrated in FIG. 3 and disclosed below.

Step S212 may also include step S220 of the alarm unit 102 monitoring for engagement of the magnetic sensor 110 for a first period of time followed by or, in some embodiments, accompanied by depression of the button 108. This would to execute a second type of self-test, which is a self-test as part of a system (for example, system-wide) test (of one or more second alarm units 103) initiated at the first alarm device 102, which is further illustrated in FIG. 4 and disclosed below. Having the magnetic sensor 110 engage with the magnet 112 for the first period of time may prevent an accidental execution of the system test by a technician. In addition, in one embodiment the magnetic sensor 110 engages the magnet 112 before the button 108 is depressed because the initial depression of the button 108 initiates the standalone test, as disclosed below.

Figure 3:
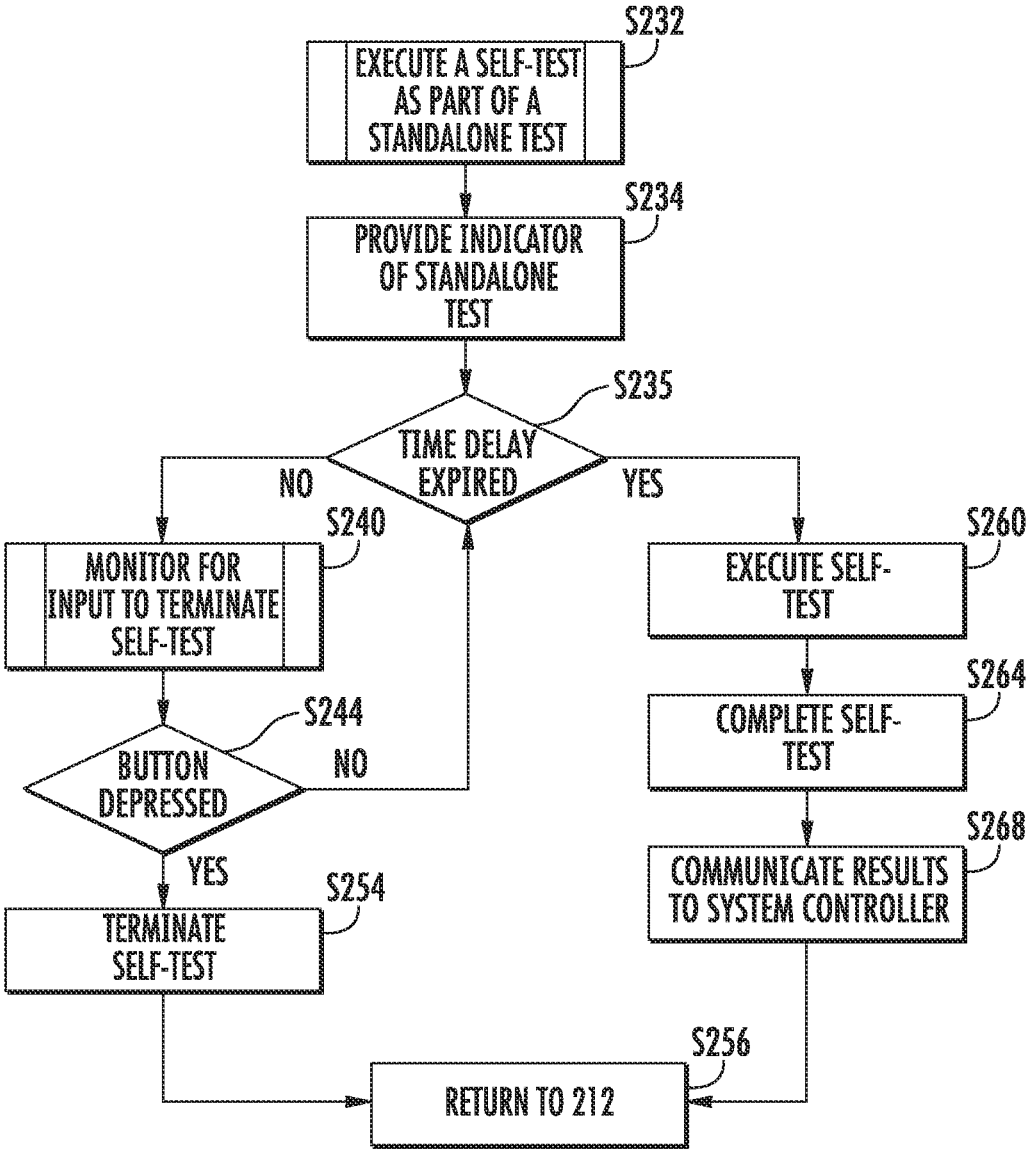
FIG. 3 is a process map illustrating a disclosed embodiment.

Step S212 may also include step S224 of monitoring for communications over the network 116 for a command (e.g. one or more specific signals) to execute a self-test. Upon receiving such a command the alarm unit 102 would execute a third type of self-test, which is a self-test as part of a system test initiated at another alarm unit, and which is further illustrated in FIG. 5, and disclosed below. Such communications may come from, for example, a second alarm unit 103. The order of steps S216-S224 as provided herein is not exclusive. When the determination at each of steps S216-S224 is "no", the alarm unit 102 may loop through step S212 and continue to monitor for input to perform one of the three exemplary tests. With reference to FIGS. 2 and 3, when the determination at step S216 is "yes" then at step S232 the alarm unit 102 may execute a self-test as part of a standalone test. Step S232 includes step S234 of providing a visual indicator of a standalone test. This indicator may be the visual implement 114 illuminating in a first color, such as green; in some embodiments the visual indicator may include the visual indicator 114 blinking in a first pattern of one or more colors. In some embodiments step S234 may also or in the alternative include an audible indicator of a standalone test. This indicator may be the speaker 106 emitting a first tone, verbal announcement, or other audible sound for a limited duration.

After step S234 the alarm unit 102 may perform step S235 of starting a delay timer for a second period of time to determine whether to continue with the standalone test as described below. The second period of time may be a few seconds and may or may not differ from the first period of time. It is to be appreciated that the first period of time and second period of time may be considered independently as the function and result of these periods of time are not necessarily coupled.

So long as the timer has not run out, the alarm unit 102 may advance to step S240 of monitoring for input to terminate the self-test, which may include step S244 of monitoring for depression of the button 108. If the determination at step S244 is "yes" within the second period of time, the alarm unit 102 may terminate the alarm self-test at step S254 and advance to step S256 at which step the alarm unit returns to step S212.

When time has run out in step S235 and the determination at step S244 remains "no" then at step S260 the alarm unit 102 may execute a self-test on, for example, the alarm controller 104 and plurality of implements including the speaker 106, the actuators 108, 110, the visual implement 114, and other elements of alarm unit 102 not shown. At step S264, at the completion of the self-test, via speaker 106 and/or visual indicator 114 the alarm unit 102 may provide an audio and/or visual confirmation that the self-test was successful and then advance to step S268 to communicate the test results to the system monitor 118. When the prescribed actions at steps S264 or S268 are not performed, or if the test results indicate a problem with one or more implements of alarm unit 102, the alarm unit 102 may need to be replaced. The system monitor 118 may display the results visually and/or audibly and may provide an alert if an alarm unit needs to be replaced.

Figure 4:
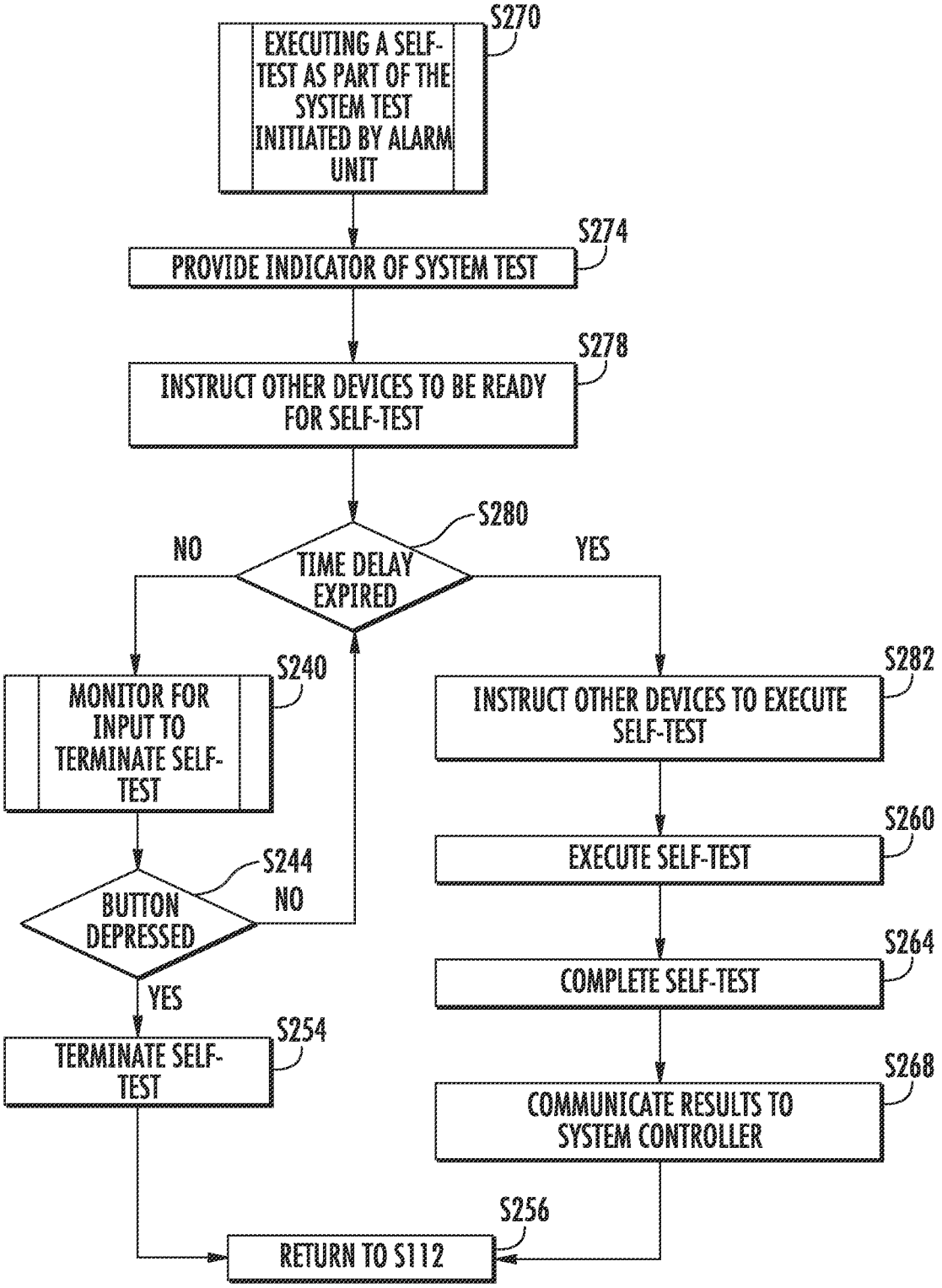
FIG. 4 is a process map illustrating a disclosed embodiment.

With reference to FIGS. 2 and 4, when the determination at step S220 is "yes" then at step S270 the alarm unit 102 may initiate a system test of all alarm units 102, 103 in the system, including initiating a self-test. Steps in the second type of test that are the same as steps in the first test are identified with the same step numbers, and for brevity a further discussion of such steps will be omitted. Step S270 includes step S274 of providing a visual indicator of a system test. The indicator may be the visual implement 114 illuminating a second color, such as red; in some embodiments the visual indicator may include the visual indicator 114 blinking in a second pattern of one or more colors. In some embodiments step S274 may also or in the alternative include an audible indicator of a standalone test. This indicator may be the speaker 106 emitting a second tone, verbal announcement, or other audible sound for a limited duration.

At step S278 the alarm unit 102 may communicate via network 116 with the plurality of alarm units 103 with a first command to prepare to perform the system test. Each of the plurality of alarm units 103 will wait to perform a self-test until receiving a second command from the alarm unit 102 to perform the system test. Requiring the plurality of alarm units 103 to receive a sequence of commands to perform a self-test helps assure that a system wide self-test will not be performed accidentally.

After step S278 thereafter the alarm unit 102 may perform step S280 of starting a delay timer for a third period of time for delaying execution of the self-test and determining whether or not to continue with executing the system test. The third period of time may be a few seconds and may be longer than the second period of time. This time differential provides a longer opportunity to cancel a system test as described below as compared to a standalone test. This is because the widespread nuisances associated with a system test are typically more significant than localized nuisances associated with a standalone test. During this time the plurality of alarm units 103 are waiting for the second command to execute a self-test as part of the system test initiated at alarm unit 102.

So long as the timer has not run out, the alarm unit 102 may advance to step S240 of monitoring for input to terminate the self-test, which may include step S244 of monitoring for depression of the button 108, for example, by a technician. If the determination at step S244 is "yes" within the third period of time, the alarm unit 102 may terminate the alarm self-test at step S254 and advance to step S256 at which step the alarm device returns to step S212. Each other alarm unit will terminate the self-test on its own based on failing to receive the second command to execute the self-test as part of the system test.

When the determination at step S244 is "no" before the time runs out, then the alarm unit 102 may perform step S282 of issuing the second command to the plurality of alarm units 103 to execute a self-test as part of the system test. The second command is communicated to alarm units 103 via network 116. Thereafter steps S260, S264, S268 and S256 may be performed as indicated above. As indicated, when the prescribed actions at steps S264 or S268 are not performed, or if the test results indicate a problem with one or more implements of alarm unit 102, the alarm unit 102 may need to be replaced. Additionally, the alarm unit may need to be replaced if the determination at step S244 is "no" before the time runs out, but the alarm unit 102 does not perform step S282 of instructing the plurality of alarm units 103 to execute a self-test.

Figure 5:
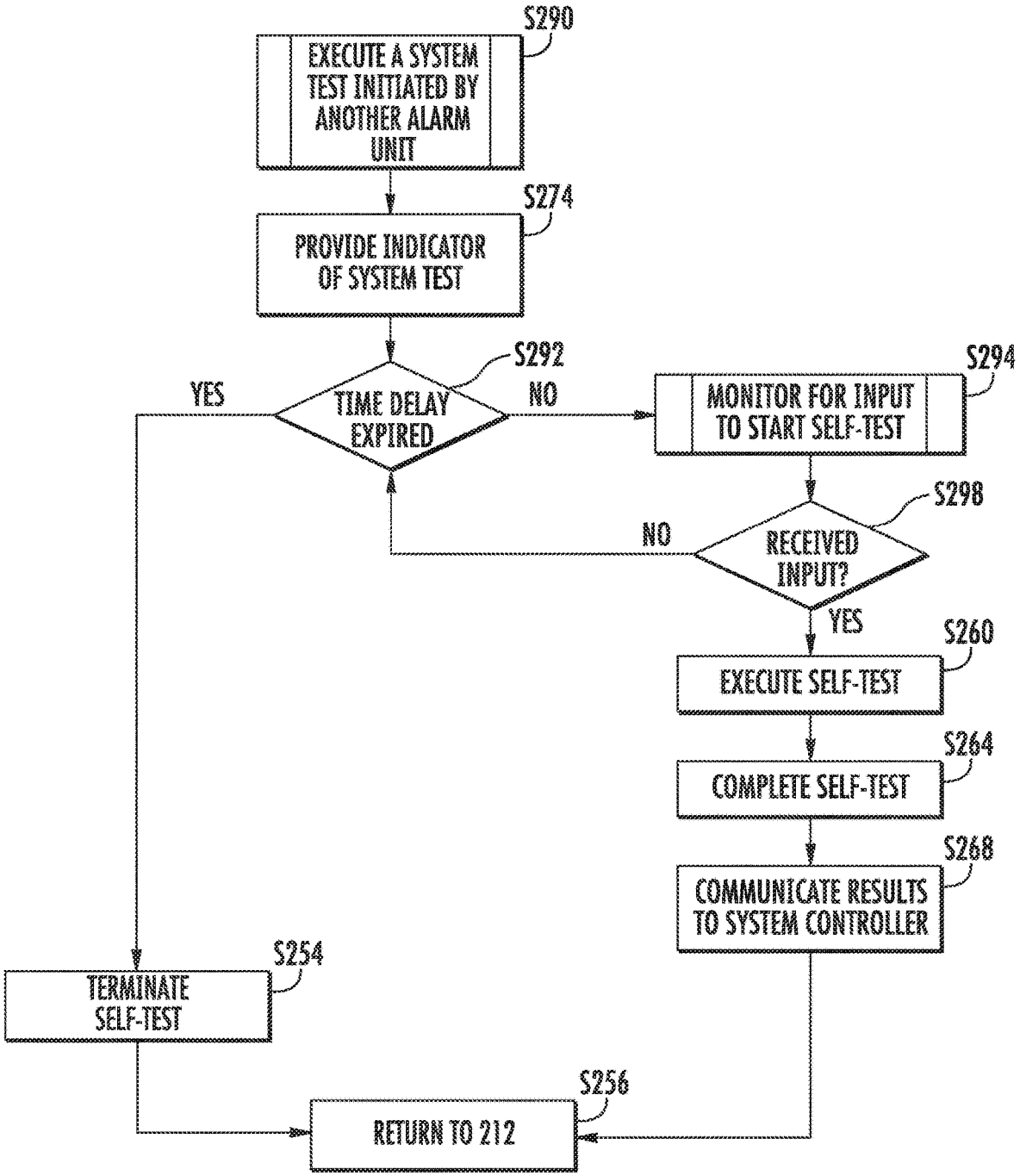
FIG. 5 is a process map illustrating a disclosed embodiment.

Turning to FIGS. 2 and 5, when the determination at step S224 is "yes" then another alarm unit, for example alarm unit 103, has transmitted instructions to each alarm unit in the plurality of alarm units to perform a self-test. Such transmission occurs during a system test of the type discussed with step S270 above. The alarm unit 102 may therefore execute step S290 of executing a self-test as instructed by the other alarm unit 103. It may be appreciated that the commands sent by alarm unit 103 and received by alarm unit 102 under this series of steps are essentially the same commands sent by alarm unit 102 and received by alarm unit 103 under the series of steps identified with step S270, above. Steps under the third type of test that are the same as steps in the first test are identified with the same step numbers, and for brevity a further discussion of such steps will be omitted.

Step S290 also includes step S274 of the alarm unit 102 providing a visual indicator of a system test. The indicator may be the visual implement 114 illuminating the second color, such as red; in some embodiments the visual indicator may include the visual indicator 114 blinking in the second pattern of one or more colors. In some embodiments step S274 may also or in the alternative include an audible indicator of a standalone test. This indicator may be the speaker 106 emitting a second tone, verbal announcement, or other audible sound for a limited duration. In some embodiments, step S274 may be omitted as the technician is at a different alarm unit in the system, that is, at alarm unit 103 which initiated the system test so that the technician would not see or hear the indicator at alarm unit 102. In yet other embodiments, visual and/or audible indicators of which test is being performed may be omitted entirely from all tests.

Step S290 includes step S292 of the first alarm unit 102 starting a delay timer for a fourth period of time for delaying execution of the self-test as part of the system test and determining whether or not to proceed with the self-test. The fourth period of time under step S292 may be at least as long as the third period of time under step S280. This is because the first alarm unit 102 executes a self-test depending on whether the second alarm unit 103 executes the self-test, as described below.

While the delay timer under step S292 is running down, the alarm unit 102 is waiting to receive a second command from alarm unit 103 to execute a self-test as part of the system test. This process is analogous to the series of steps following step S280 above. Thus if the system test is initiated at the second alarm unit 103, then unless the system test is actively cancelled at the second alarm unit 103 before the delay timer runs down, the second alarm unit 103 will transmit the second command to the alarm unit 102 which instructs the alarm unit 102 to perform the self-test.

When time runs out, and the alarm unit 102 has not received instructions to execute the self-test, the alarm unit 102 may execute step S254 of terminating the self-test. Thereafter the alarm unit 102 executes step S256 of returning to step S212 of monitoring for input to initiate a self-test.

While time has not run out, step S292 will be followed by S294 of the alarm unit 102 monitoring for communications over the network 116 for the second command to start the self-test. In this test the second command would come from the alarm unit which initiated the test, for example the second alarm unit 103. While such sequence of communications from the second alarm unit 103 has not been received, the determination at step S298 will be "no" and the alarm unit will cycle back to step S292. When such additional input is received at the first alarm unit 102 before the time runs out at step S292, the alarm unit 102 will execute steps S260, S264, S268 and S256 as indicated above. Here too, when the prescribed actions at steps S264 or S268 are not performed, or if the test results indicate a problem with one or more implements of alarm unit 102, the alarm unit 102 may need to be replaced.

With the above embodiments, the system test mode is hidden from the end user. This is because without a magnet 112, the end user will not be able to engage the magnetic sensor 110 and execute the system test mode. This will reduce a possibility of system-wide nuisance alarms due to unauthorized tampering or mishandling of the alarms. In addition, when a system test mode is initiated at an alarm unit, it cannot be cancelled at a remote alarm unit by depressing the button on the remote alarm unit. This prevents unwanted disruption of system tests which could lead to a faulty determination that the remote alarm unit is defective. The availability of the system test mode for the technician equipped with the magnet 112 will also preserve integrity of the interconnected devices and ensure all devices work together as a system. It is to be appreciated that the above process may be used in systems other than smoke detectors with networking features and a test requirement.

The term "about" is intended to include the degree of error associated with measurement of the particular quantity based upon the equipment available at the time of filing the application. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An alarm unit comprising:

an alarm controller, the alarm controller being operatively connected to a plurality of implements within the alarm unit comprising a mechanical actuator and a magnetic sensor and at least one of a visual source and an audible source, wherein the alarm unit:

monitors for input to initiate one of a plurality of self-tests including:

a first test, initiated by actuation of the mechanical actuator without actuation of the magnetic sensor, and a second test, initiated by actuation of the mechanical actuator with actuation of the magnetic sensor, and wherein the first test differs from the second test;

wherein:

the alarm unit is a first alarm unit of a plurality of alarm units, the plurality of alarm units forming an alarm system;

the first test is a self-test initiated by the first alarm unit as a standalone test, wherein the first test comprises the first alarm unit performing the self-test when the mechanical actuator is first actuated and thereafter a first period of time lapses without a second actuation of the mechanical actuator; and the second test is a self-test initiated by the first alarm unit as part of an alarm system test, wherein the second test comprises the first alarm unit providing the plurality of alarm units with a first instruction to perform the self-test after the mechanical actuator is first actuated and thereafter the magnetic sensor is engaged within a second period of time.

2. The alarm unit of claim 1, wherein the first test comprises the first alarm unit cancelling the self-test upon the second actuation of the mechanical actuator within the first period of time.

3. The alarm unit of claim 1, wherein the second test comprises the first alarm unit providing the plurality of alarm units with a second instruction to perform the self-test after a third period of time lapses without a second actuation of the mechanical actuator.

4. The alarm unit of claim 3 wherein the second test comprises the first alarm unit performing the self-test after the third period of time lapses without the second actuation of the mechanical actuator.

5. The alarm unit of claim 1 wherein the plurality of self-tests includes a third test, which is a self-test as a part of a system test, initiated by the first alarm unit following receiving a first instruction from a second alarm unit of the plurality of alarm units.

6. The alarm unit of claim 5 wherein the third test comprises the first alarm unit performing the self-test after receiving a second instruction from the second alarm unit during a fourth period of time that runs after receiving the first instruction.

7. The alarm unit of claim 6 wherein the third test comprises the first alarm unit cancelling the self-test after the fourth period of time has lapsed without receiving the second instruction from the second alarm unit.

8. A method of operating an alarm unit, the alarm unit comprising an alarm controller, the alarm controller being operatively connected to a plurality of implements within the alarm unit comprising a mechanical actuator and a magnetic sensor, and one or more of a visual source and an audible source, wherein the method includes the alarm unit:

monitoring for input to initiate one of a plurality of self-tests including:

a first test, initiated by actuation of the mechanical actuator without actuation of the magnetic sensor, and a second test, initiated by actuation of the mechanical actuator with actuation of the magnetic sensor, and wherein the first test differs from the second test;

wherein:

the alarm unit is a first alarm unit of a plurality of alarm units, the plurality of alarm units forming an alarm system;

the first test is a self-test initiated by the first alarm unit as a standalone test, wherein the first test comprises the first alarm unit performing the self-test when the mechanical actuator is first actuated and thereafter a first period of time lapses without a second actuation of the mechanical actuator; and the second test is a self-test initiated by the first alarm unit as part of an alarm system test, wherein the second test comprises the first alarm unit providing the plurality of alarm units with a first instruction to perform the self-test after the mechanical actuator is first actuated and thereafter the magnetic sensor is engaged within a second period of time.

9. The method of claim 8, wherein the first test comprises the first alarm unit cancelling the self-test upon the second actuation of the mechanical actuator within the first period of time.

10. The method of claim 8, wherein the second test comprises the first alarm unit providing the plurality of alarm units with a second instruction to perform the self-test after a third period of time lapses without a second actuation of the mechanical actuator.

11. The method of claim 10 wherein the second test comprises the first alarm unit performing the self-test after the third period of time lapses without the second actuation of the mechanical actuator.

12. The method of claim 11 wherein the plurality of self-tests includes a third test, which is a self-test as a part of a system test, initiated by the first alarm unit following receiving a first instruction from a second alarm unit of the plurality of alarm units.

13. The method of claim 12 wherein the third test comprises the first alarm unit performing the self-test after receiving a second instruction from the second alarm unit during a fourth period of time that runs after receiving the first instruction.

14. The method of claim 13 wherein the third test comprises the first alarm unit cancelling the self-test after the fourth period of time has lapsed without receiving the second instruction from the second alarm unit.

* * * * *